United States Patent [19]

Graff

[11] Patent Number: 4,500,810

[45] Date of Patent: Feb. 19, 1985

[54] FLUORESCENT LAMP HAVING INTEGRAL LIGHT-FILTERING MEANS AND STARTING AID

[75] Inventor: Eugene A. Graff, Cedar Grove, N.J.

[73] Assignee: North American Philips Lighting Corporation, New York, N.Y.

[21] Appl. No.: 513,258

[22] Filed: Jul. 13, 1983

Related U.S. Application Data

[63] Continuation of Ser. No. 210,428, Nov. 25, 1980, abandoned.

[51] Int. Cl.[3] ..... H01J 1/62

[52] U.S. Cl. ..... 313/486; 313/489

[58] Field of Search ..... 313/486, 487, 636, 572, 313/489

[56] References Cited

U.S. PATENT DOCUMENTS

| | | | |
|---|---|---|---|
| 2,299,720 | 10/1942 | Holman . | |
| 2,692,349 | 10/1954 | Ouweltjes . | |
| 2,733,371 | 1/1956 | Campbell | 313/185 |
| 2,838,707 | 6/1958 | Schwing et al. . | |
| 3,377,494 | 4/1968 | Repsher . | |
| 3,541,376 | 11/1970 | Sadoski et al. | 313/221 |
| 3,624,444 | 11/1971 | Berthold . | |
| 3,875,454 | 4/1975 | Van Der Wolf et al. . | |
| 4,129,802 | 12/1978 | Vrenken et al. | 313/489 |

*Primary Examiner*—Bruce C. Anderson

[57] ABSTRACT

Reliable starting of a fluorescent lamp that is designed to emit light of a selected color (red, for example) is achieved by using a thin transparent coating of conductive material (such as tin oxide) on the inner surface of the glass envelope in combination with a first overlying layer of a suitable light-filtering pigment material and a second overlying layer of a suitable phosphor. The resulting multi-layered arrangement of such materials and the phosphor eliminates the need for including additives (such as admixed silica and barium sulfate) in the phosphor coating as starting aids and solves the problems of poor light output and unreliable starting which are created by the use of such additives. Multiple layers of pigment material having the proper coating density can also be used.

10 Claims, 4 Drawing Figures

FLUORESCENT LAMP HAVING INTEGRAL LIGHT-FILTERING MEANS AND STARTING AID

This is a continuation of application Ser. No. 210,428 filed Nov. 25, 1980, abandoned.

BACKGROUND OF THE INVENTION

This invention generally relates to electric discharge lamps and has particular reference to an improved fluorescent lamp which has light output of a selected color and can be readily manufactured and started.

Fluorescent lamps which are designed to emit light of a predetermined color are well known in the art and achieve the desired color-controlled light output by employing suitable combinations of phosphors and light-filtering materials. For example, in the case of a red-emitting fluorescent lamp designed for use as a light source for a photographic dark room or as a decorative lamp, a phosphor coating that emits mainly in the red region of the spectrum in response to the ultraviolet radiations produced by the arc discharge is combined with an underlying layer of red pigment that filters out all of the visible radiations below a certain wavelength (600 nm, for example). While such filtering produces a corresponding reduction in the total light output of the lamp, the radiations which are transmitted provide the pure red light which is desired. A prior art fluorescent lamp which utilizes this color-controlling concept and combines a suitable phosphor and a filter material to provide a lamp which emits mainly in the yellow and red regions of the spectrum and thus serves as an insect repellent lamp is disclosed in U.S. Pat. No. 2,838,707 issued June 10, 1958 to Schwing et al. The light-filter in the prior art lamp comprises a layer of cadmium sulphide which underlies the phosphor coating and is admixed with finely divided silicon dioxide that serves as a starting aid and permits the lamp to be operated as a "quick starting" lamp.

A fluorescent lamp that produces gold-colored light by combining a pink-emitting phosphor (such as zinc beryllium silicate) and a filter layer composed of a pigment such as cadmium sulfide that contains up to about 50% by weight of barium sulfate is disclosed in U.S. Pat. No. 2,299,720 issued Oct. 20, 1942 to Holman.

The use of a transparent film of conductive material such as tin oxide on the inner surface of a fluorescent lamp envelope to facilitate lamp starting is also well known in the art. Low-pressure discharge lamps having such starting aids are disclosed in U.S. Pat. Nos. 3,624,444 (Berthold et al.) and 4,129,802 (Vrenken).

In order to avoid the lamp-starting problems which inherently result from the use of thin layers of pigment material in fluorescent lamps to filter out light rays of undesired colors, the prior art practice was to include various additives in the phosphor paint to facilitate starting of the finished lamp. In the case of red-emitting fluorescent lamps that utilize a thin layer of cadmium-selenium sulfide pigment as the filter component together with a phosphor which has an emission mainly in the red portion of the spectrum, a prior art practice was to add a mixture of barium sulfate and silica to the phosphor paint as a starting aid in amounts that frequently exceeded 40% by weight or more of the phosphor coating. Since such additives are inert (non-fluorescent) they significantly reduce the "red light" output of the lamp and, more importantly, do not completely solve the lamp-starting problem.

SUMMARY OF THE INVENTION

In accordance with the present invention, the foregoing manufacturing and quality-control problems associated with fluorescent lamps having an interior coating of a light-filtering material that coacts with the phosphor layer to control the color of the light produced by the lamp are solved by providing the inner surface of the lamp envelope with a transparent film of tin oxide or the like that is slightly conductive and, as such, serves as a starting aid. This multi-layered construction eliminates the need for adding inert starting-aid substances to the phosphor coating and avoids the resultant impairment of the ability of the phosphor particles to convert the ultraviolet radiations into light rays of the desired color. The use of such a conductive film, in combination with separate, layers or coatings of suitable light-filtering and phosphor materials, thus not only enhances the controlled-light output of the lamp but ensures that the lamp will start in a reliable fashion when placed into a lighting fixture and energized.

BRIEF DESCRIPTION OF THE DRAWINGS

A better understanding of the invention will be obtained from the exemplary embodiments shown in the accompanying drawing, wherein.

DESCRIPTION OF THE PREFERRED EMBODIMENTS

While the present invention can be used with advantage in various kinds of low-pressure electric discharge lamps which are designed to have a light output that is restricted to a selected color by a light-filtering component, it is especially adapted for use in conjunction with color-controlled fluorescent lamps that employ mercury vapor as the principal ionizing medium and it has accordingly been so illustrated and will be so described.

Figure 1:
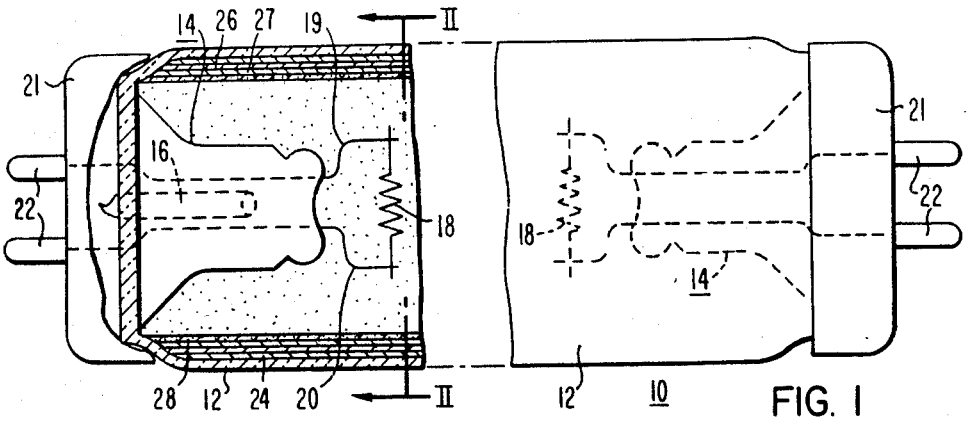
FIG. 1 is an enlarged fragmentary view, partly in section, of a fluorescent lamp that embodies the invention.

A representative fluorescent lamp 10 of the aforementioned type which embodies the present invention is shown in FIG. 1 and consists of the usual light-transmitting envelope 12 of glass tubing that is sealed at each end by a stem assembly 14 that includes a conventional thermionic electrode 18. The electrodes 18 are connected to lead-in wires 19, 20 that are hermetically joined to and extend through the respective stems 14 in the customary manner. Base members 21 are fastened to the sealed ends of the envelope 12 and carry contact members such as metal pins 22 that are connected to the respective pairs of lead wires 19, 20 and permit the lamp electrodes 18 to be connected to a suitable power source. As will be noted, one of the stem assemblies 14 is provided with an exhaust tubulation 16 through which the envelope 12 is evacuated, provided with a suitable fill gas (such as a few Torr of argon or the like), and then dosed with a measured amount of mercury in the usual manner before the tubulation is tipped-off. The fill gas and mercury vapor comprise the ionizable medium which sustains the arc discharge when the lamp 10 is energized.

In accordance with the present invention, the fluorescent lamp 10 is provided with integral means which not only transforms the ultraviolet radiations generated by the electric discharge into a light output of a preselected color but also provides a reliable lamp-starting capability without the use of any additive in the phosphor coating. These objectives are achieved by successively coating the inner surface of the lamp envelope 12 with a thin substantially transparent film 24 of a suitable conductive material (such as tin oxide), two overlapping layes 26 and 27 of a suitable inert pigment that serve as light-filtering means, and an overlying layer 28 of a suitable phosphor that is exposed to the discharge and excited by the impinging ultraviolet radiations to emit visible radiations mainly in the portion of the spectrum that corresponds to the desired color.

Figure 2:
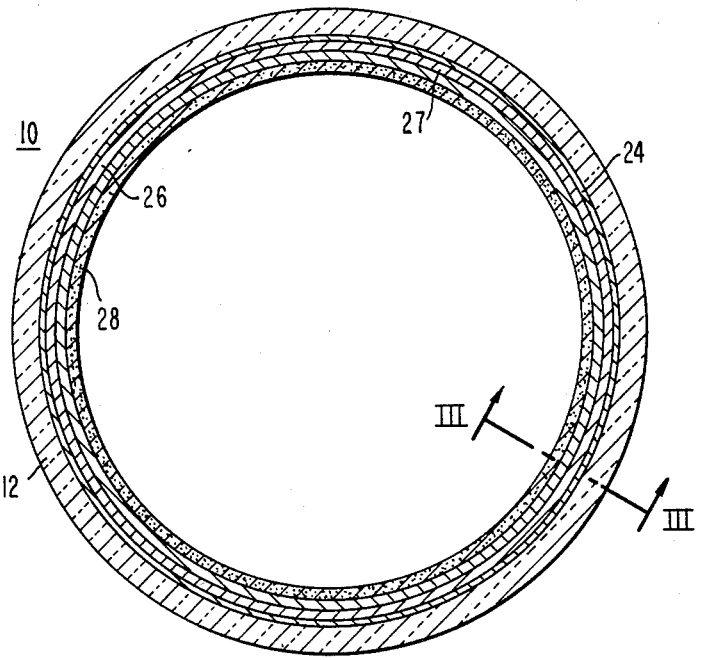
FIG. 2 is a cross-sectional view through the lamp, along line II—II of FIG. 1, showing the various bulb coatings in even greater detail.
Figure 3:
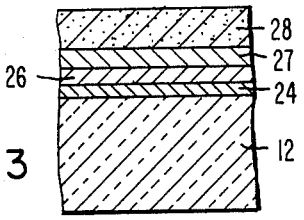
FIG. 3 is an enlarged cross-sectional view of a coated segment of the lamp bulb, along line III—III of FIG. 2.

As shown more particularly in FIGS. 2 and 3, the conductive film or layer 24 is quite thin and extends over substantially the entire inner surface of the envelope 12. The pigment layers 26 and 27 are also thin compared to the phosphor coating 28. It should be noted, however, that the relative thicknesses of the bulb wall and respective coatings or layers as illustrated are not to scale and merely provide a rough approxmation of their relative dimensions.

The transparent-conductive coating 24 of tin oxide or other suitable material (such as indium oxide) need only be very slightly electrically-conductive in order to provide reliable starting of the finished lamp 10. In the case of 40 watt fluorescent lamps having conventional tubular envelopes approximately 122 cms. in length, bulb resistances (that is, the total electrical resistance of the entire conductive film or coating) in the order of between about 25,000 ohms and 200,000 ohms have provided satisfactory results. The quantity of conductive coating material per lamp which is required is thus very small and can readily be deposited on the bulb surface. However, the conductive film thickness and resistivity are not especially critical and heavier conductive coatings (total resistance of around 6,000 to 9,000 ohms) will also work and can be used, as long as they are sufficiently light-transmitting. The conductive film or coating 24 is deposited on the inner surface of the bulb 12 in accordance with well known vaporization or chemical deposition techniques.

The thickness of the light-filtering layers 26 and 27 is also not critical but should be sufficient to absorb or block enough of the undesired visible radiations produced by the phosphor coating 28 to provide a light output that has the desired color and purity. As a specific example, a 40 watt tubular fluorescent lamp having a coating of pink-emitting cadmium borate phosphor (activated by manganese) provided a deep red light output of approximately 200 lumens when two separate overlapping layers of cadmium-selenium sulfide pigment (each layer containing approximately 0.35 milligram of pigment per cm.$^2$ of bulb surface) were used as the light-filtering means to block or absorb visible radiations having wavelengths below about 600 nm. The layers or coatings of phosphor and pigment materials are deposited in accordance with well-known lamp-making techniques by dispersing the materials in a suitable liquid vehicle to form a paint which is applied to the bulb and then dried and baked to produce the finished coatings.

Figure 4:
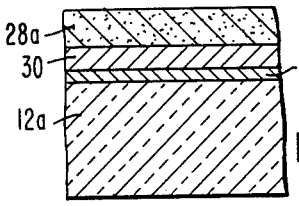
FIG. 4 is a similar view of an envelope segment of an alternative fluorescent lamp embodiment which employs a single pigment layer that serves as the light-filtering means.

The invention is not limited to low-pressure discharge lamps which have several layers of light-filtering material but includes within its scope lamps which are provided with a single layer of pigment material. The envelope **12*a* of such an alternative fluorescent lamp embodiment is shown in FIG. 4 and, in addition to the transparent-conductive film 24*a* and phosphor coating 28*a*, includes a single layer 30** of suitable inert pigment that is of sufficient thickness to absorb the undesirable light rays emitted by the phosphor and produce light of the desired color without excessively reducing the usable light output of the lamp. In the case of the red-emitting 40 watt fluorescent lamp described above, a single layer of cadmium-selenium sulfide pigment having a coating thickness equivalent to about 0.6 to 0.7 mg. of pigment per cm.$^2$ of bulb surface can be used.

It will be also appreciated by those skilled in the art that the invention is not limited to red-emitting fluorescent lamps but can be used in fluorescent lamps that have outputs of various colors (for example, blue, yellow, etc.) by using the proper combinations of phosphor and pigment materials in the respective coatings. Some examples of such combinations are listed below in Table I.

TABLE I

| Phosphor | Pigment | Lamp Color |
|---|---|---|
| Strontium Magnesium Phosphate: Tin (Pink) | Cadmium-Selenium Sulfide | Red |
| Warm White Halophosphate | Cadmium Sulfide | Yellow |
| Yttrium Oxide: Europium (Red) | Cadmium-Selenium Sulfide | Red |
| Strontium Chloroapatite: Europium (Blue) | Cobalt | Blue |

I claim as my invention:

1. A low-pressure fluorescent lamp having a visible selected color light output, comprising an elongated outer sealed light-transmitting envelope, a respective electrode adjacent each end of said envelope, an electric discharge-sustaining ionizable medium contained within said envelope, and at least outermost, next, and innermost separate layers of material arranged on the inner elongated surface of said envelope, said outermost layer being electrically conductive and having a thickness selected such that the outermost layer is substantially transparent to visible light, and having a thickness and layer composition selected to function as a starting aid for the lamp, said next layer being substantially non-conductive electrically and having a composition and thickness selected to transmit visible light rays of said selected color and to absorb visible light rays of at least another color, and said innermost layer being substantially non-conductive electrically and having a composition and thickness selected such that, when irradiated by an electric discharge sustained in said medium, said innermost layer emits visible light radiations outwardly, said visible light radiations comprising primarily said selected color and said at least another color.

2. A lamp as claimed in claim 1, wherein said next layer comprises two overlapping layers of an inorganic pigment having respectively identical composition.

3. A lamp as claimed in claim 1, wherein said next layer consists of a single layer comprising a selected inorganic pigment.

4. A lamp as claimed in claim 1, wherein said ionizable medium comprises mercury and a rare gas.

5. A lamp as claimed in claim 4, wherein said envelope is tubular in shape and composed of a glass composition, and said outermost coating has a total electrical resistance between ends of the coating adjacent each end of said envelope in the range from about 6,000 to 200,000 ohms.

6. A lamp as claimed in claim 5, wherein said outermost coating consists essentially of tin oxide and covers substantially the entire inner surface of said envelope, electrical resistance of the film between the ends of the evelope being in the range from about 25,000 to 200,000 ohms.

7. A lamp as claimed in claim 6, wherein said selected color is a red color, said innermost layer emits light mainly in the red portion of the spectrum, and said next layer absorbs substantially all visible light having a wavelength shorter than approximately 600 nm.

8. A lamp as claimed in claim 6, wherein said innermost layer comprises pink-emitting cadmium borate phosphor, and said next layer comprises a coating of red pigment.

9. A lamp as claimed in claim 8, wherein said next layer comprises two overlapping layers of cadmium-selenium sulfide.

10. A lamp as claimed in claim 8, wherein said next layer comprises a single layer only of cadmium-selenium sulfide.

* * * * *